US006830426B1

(12) United States Patent
Stilcs

(10) Patent No.: US 6,830,426 B1
(45) Date of Patent: Dec. 14, 2004

(54) GAS INJECTION SEAL SYSTEM FOR A CENTRIFUGAL PUMP

(76) Inventor: David T. Stilcs, P.O. Box 773064, Eagle River, AK (US) 99577

( * ) Notice: Subject to any disclaimer, the term of this patent is extended or adjusted under 35 U.S.C. 154(b) by 242 days.

(21) Appl. No.: 10/193,841

(22) Filed: Jul. 11, 2002

(51) Int. Cl.[7] ..... F04D 29/08; F04D 29/16

(52) U.S. Cl. ..... 415/1; 415/110; 415/172.1; 415/173.6; 277/408; 277/432

(58) Field of Search ..... 415/110, 111, 415/112, 113, 172.1, 173.6, 174.2, 174.3, 1; 277/408, 431, 432

(56) References Cited

U.S. PATENT DOCUMENTS 794,185 A * 7/1905 Meden ..... 415/172.1
835,836 A * 11/1906 Schulz ..... 415/174.5
1,820,150 A * 8/1931 Moody ..... 415/172.1
2,013,499 A * 9/1935 Meckenstock ..... 415/112
2,604,050 A * 7/1952 Wilson ..... 415/174.2
3,245,656 A * 4/1966 Desbaillets et al. ..... 415/112
3,797,962 A * 3/1974 Stahlecker ..... 415/174.5
5,297,928 A * 3/1994 Imakiire et al. ..... 415/112

FOREIGN PATENT DOCUMENTS

GB 932632 A * 7/1963 ..... 415/110

* cited by examiner

*Primary Examiner*—Christopher Verdier
(74) *Attorney, Agent, or Firm*—Michael J. Tavella

(57) ABSTRACT

A set of seals is installed on the impeller of a centrifugal pump that allows a low viscosity fluid to be injected into a chamber between the impeller shroud and the casing side-wall. A seal ring, with a number of grooves formed in it is installed on the tip of the impeller. Another seal ring is mounted at the leading edge of the eye of the impeller. The gas is picked up by the grooves in the impeller tip ring inside diameter and is compressed by centrifugal force to a higher pressure than the discharge pressure of the impeller. It is then injected into the pumpage stream. The eye ring seals have pockets or grooves and inject gas at a low volume into the eye of the impeller.

18 Claims, 9 Drawing Sheets

GAS INJECTION SEAL SYSTEM FOR A CENTRIFUGAL PUMP

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to gas injection seal systems for centrifugal pumps and particularly to centrifugal pumps disk friction reducing injection rings and eye ring seals.

2. Description of the Prior Art

In the prior art, centrifugal pumps with closed impellers (i.e., those with shrouds on both sides of the vanes) have a cavity between the impeller and the pump casing. Also, a small radial gap exists at the eye of the impeller between the rotating impeller and the stationary casing, which is called the wear ring gap. The designs allow fluid at discharge pressure from the impeller to circulate behind the impeller shroud in the cavity between the shroud and the casing. It also allows a certain quantity of fluid to leak back to the suction side of the impeller through the wear ring gap. As the impeller rotates, the fluid behind the impeller creates a power loss due to the shearing of the fluid between the impeller shroud and the casing wall. The wear ring leakage also creates a power loss because the leaking fluid loses all of the energy that the impeller imparted to it and then is reintroduced to the suction stream to be pumped again.

BRIEF DESCRIPTION OF THE INVENTION

The instant invention overcomes all of these problems. In the instant design, a set of seals is installed on the impeller that allows a low viscosity fluid (typically gas) to be injected into a chamber between the impeller shroud and the casing sidewall at a pressure higher than suction pressure.

On each impeller shroud there is a seal ring installed on the tip of the impeller's outer perimeter. Another seal ring is mounted at the leading edge of the eye of the impeller. The seals installed on the tip of the impeller (tip seals) have a series of grooves formed in them that are open to the chamber on the backside of the impeller shroud. A gas is injected through a port in the case and into a chamber formed by the tip seal, the eye ring seal, the impeller shroud and the casing wall. The gas is then picked up by the grooves in the impeller tip seal ring inside diameter and is compressed by centrifugal force to a higher pressure than the discharge pressure of the impeller. It is then injected into the pumpage stream. The eye ring seals have pockets and inject gas at a low volume into the eye of the impeller. In this way, both leakage problems described above can be eliminated. The disk friction reducing injection mechanism drastically reduces the losses associated with disk friction and wear ring leakage losses. This combination increase pump efficiencies.

This invention can work on a variety of centrifugal pump types including double suction impellers; single suction closed impellers and open face impellers with a single shroud.

DETAILED DESCRIPTION OF THE INVENTION

Figure 1:
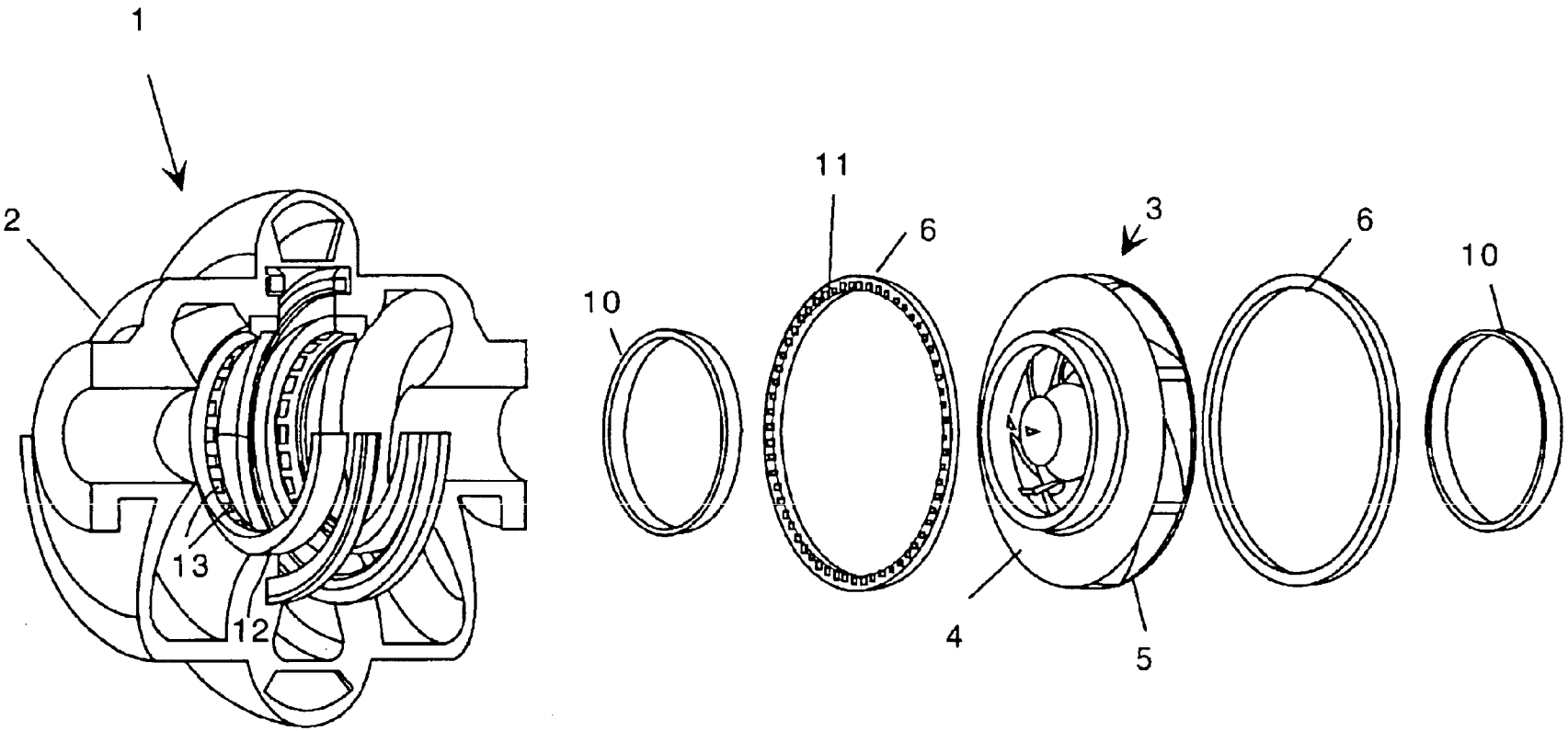
FIG. 1 is a partial exploded view of the disk friction reducing injection system.
Figure 2:
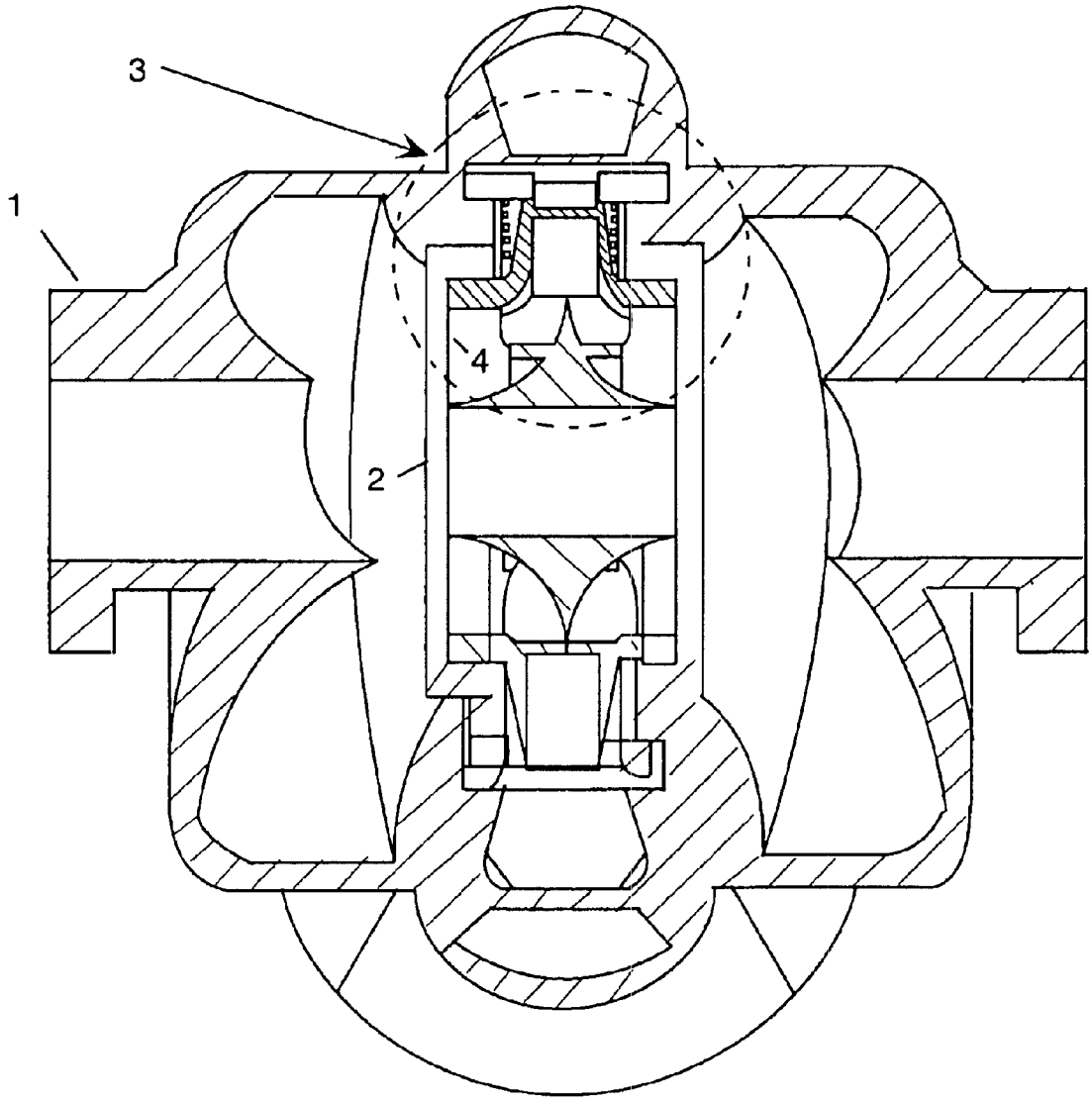
FIG. 2 is a cross-sectional view of the invention.
Figure 3:
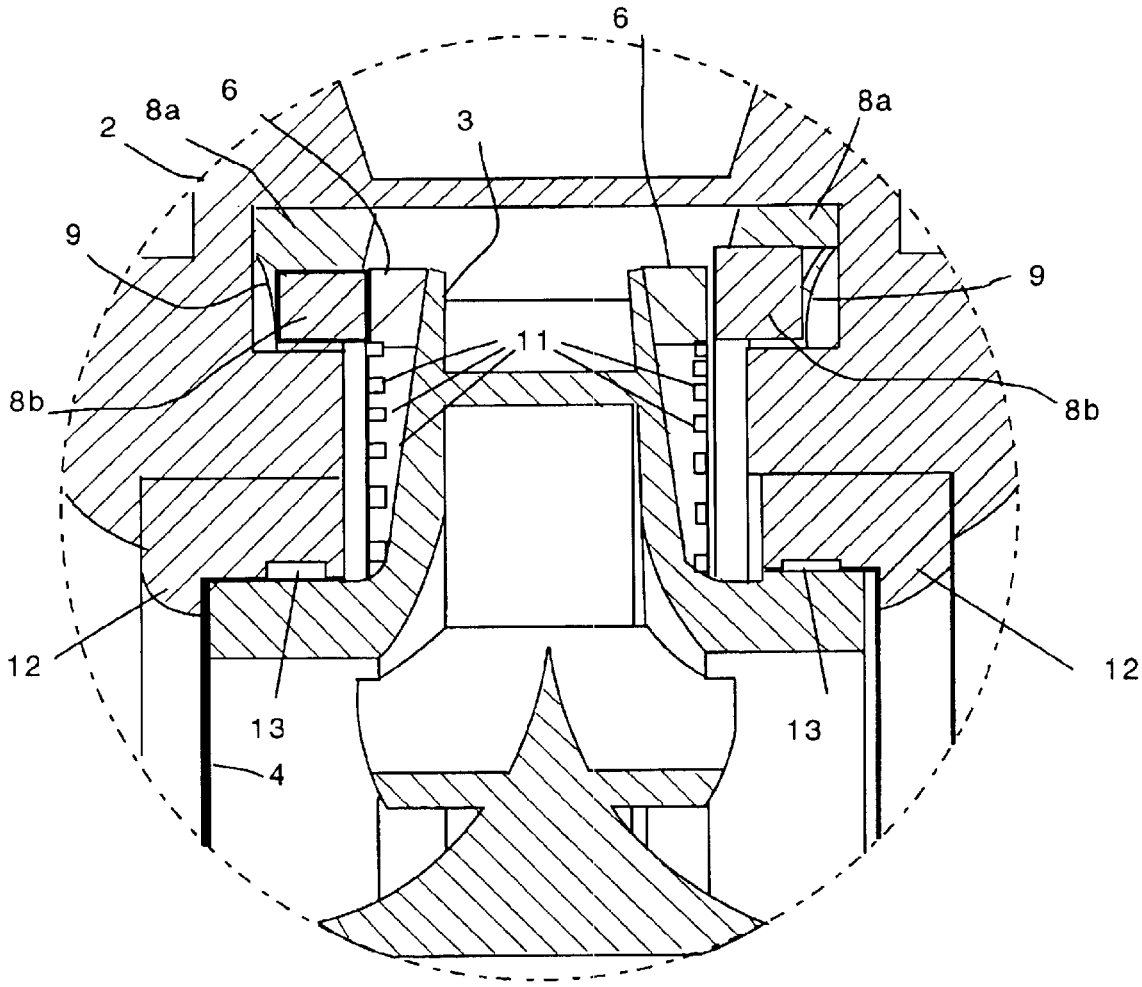
FIG. 3 is an inset of the invention as shown in cross-section of FIG. 2.

Referring new to FIGS. 1, 2 and 3 the invention is a centrifugal pump 1 that has an outer casing 2. Within the outer casing there is an impeller 3 that has two disk shrouds 4 that enclose the vanes 5. Two seal rings 6 (also called tip seal rings) are mounted to the impeller disk shrouds at the tip of the outer diameter of the impeller 3 to prevent fluid from leaking from the impeller 3 into the chamber 7 between the shroud disks 4 and the casing 2. (See FIG. 4). The chambers 7 are used in part to inject gas into the pump, as discussed below.

A two-part mating seal ring 8*a* and 8*b* is mounted to the case 2 for each tip ring seal. In the preferred embodiment, the compliant structure includes a spring 9. See FIG. 3. However, other similar structures may also be used.

A tip seal ring 6 that has a number of grooves 11 that allow a gas to be compressed due to the centrifugal force is installed on the tip of the impeller. The gas is discussed in more detail below. The groove depth flow area at the inner diameter of the ring is significantly greater than the discharge area of the seal allowing for full head development. For example, for a seal discharge area of 0.068 $in^2$ (0.439 $cm^2$), the groove depth flow area at the inner diameter of the ring is typically between 0.204 $in^2$ (1.31 $cm^2$) and 0.272 $in^2$ (1.75 $cm^2$).

Figure 5:
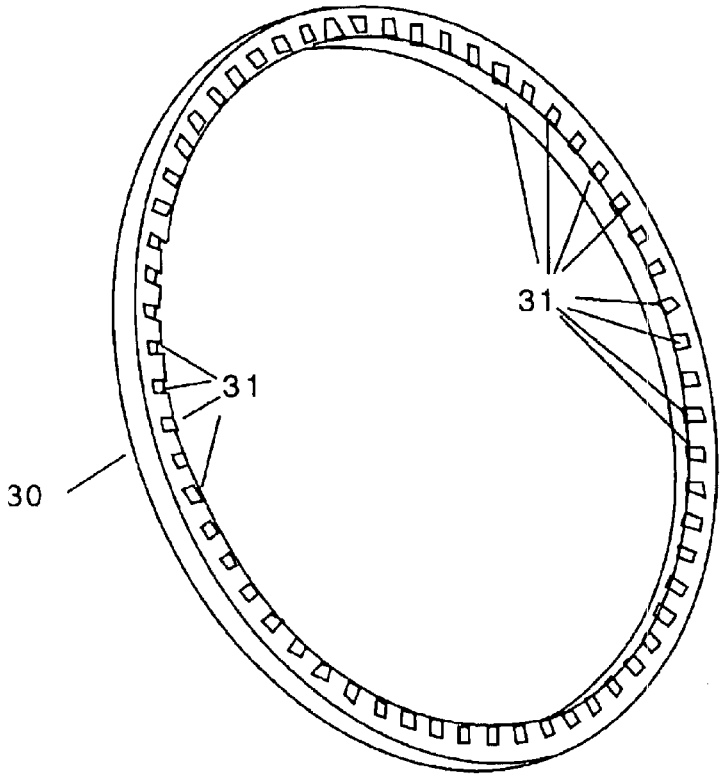
FIG. 5 is a perspective view of a tip ring showing one style of groove pattern.
Figure 5A:
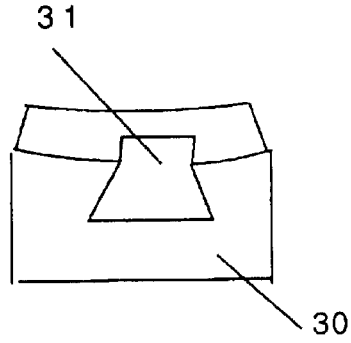
FIG. 5*a* is an enlarged view of one of the radial tapered trapezoid grooves in the top ring of FIG. 5.

The preferred grooving is a radial tapered trapezoid that extends from a narrow throat at the inside diameter to a broad shallow structure at a diameter that is not greater than the outside diameter creating sealing dam. See FIG. 5*a*. These grooves allow the gas on the chamber side of the impeller to be injected into the discharge stream of the impeller. FIG. 5 shows a tip ring 30 having a number of radial tapered grooves 31. See also FIG. 5*a*.

Figure 6:
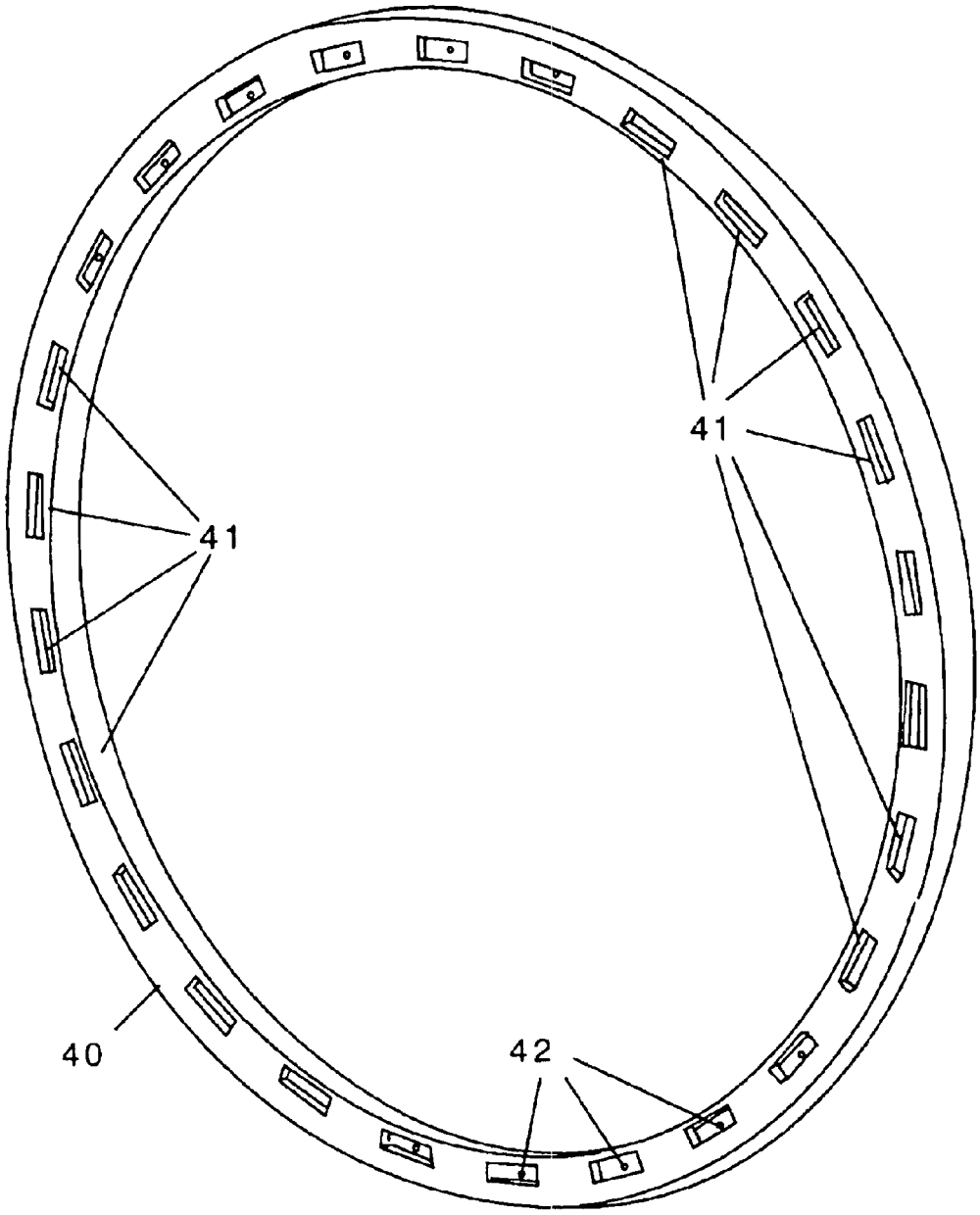
FIG. 6 is a perspective view of a second tip ring showing a second groove pattern.
Figure 7:
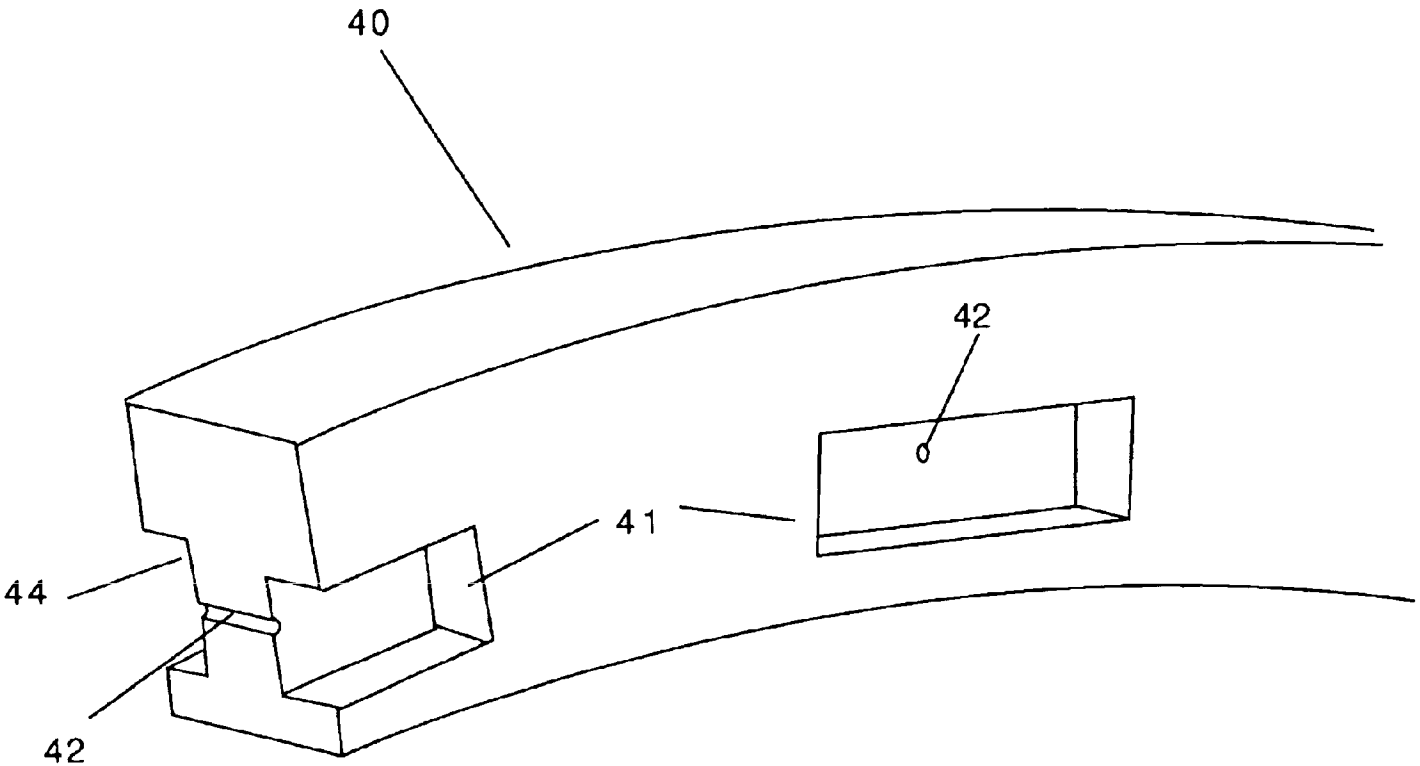
FIG. 7 is an enlarged detail view of a portion of the tip ring of FIG. 6.

Moreover, instead of tapered grooves for the seal rings, recessed pockets can be utilized and gas can be directly injected into the pocket. These are shown in FIGS. 6 and 7. FIG. 6 shows the seal ring 40 having a number of recessed pockets 41. Within each pocket is an injection port 42. This structure creates a hydrostatic force in the pocket and allows for a gas seal. In one embodiment, multiple pockets 41 can be arranged around the diameter of the ring 40 and an external gas source is brought directly to an annular groove 44 that distributes the gas to all of the pockets. The small diameter hole 42 connects each pocket with the annular groove. The pressurized gas is then injected between the faces to create a seal. The design can either be on a face, taper or annular design.

Figure 8A:
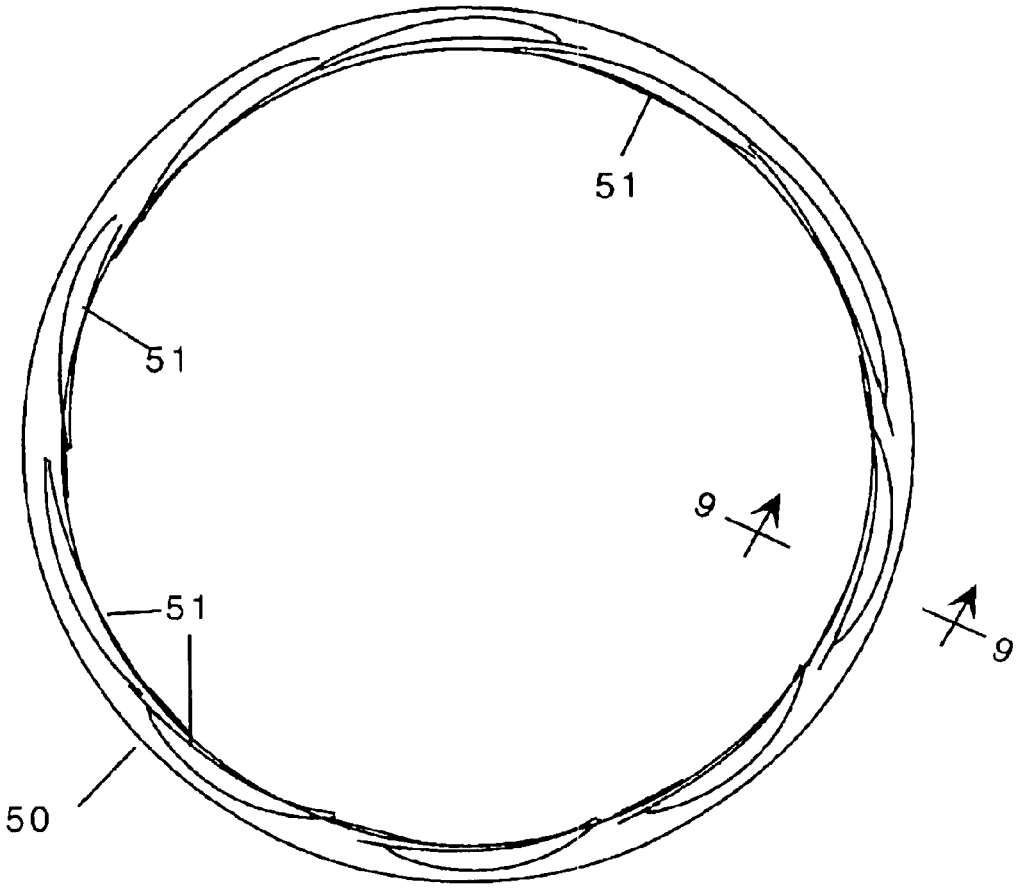
FIG. 8*a* is a front view of a tip ring having a third groove pattern with a first profile.
Figure 9:
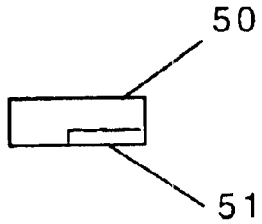
FIG. 9 is a cross-sectional view taken along the lines 9—9 of FIG. 8*a* of one of the grooves of FIG. 8*a* showing the pattern as being rectangular.
Figure 8B:
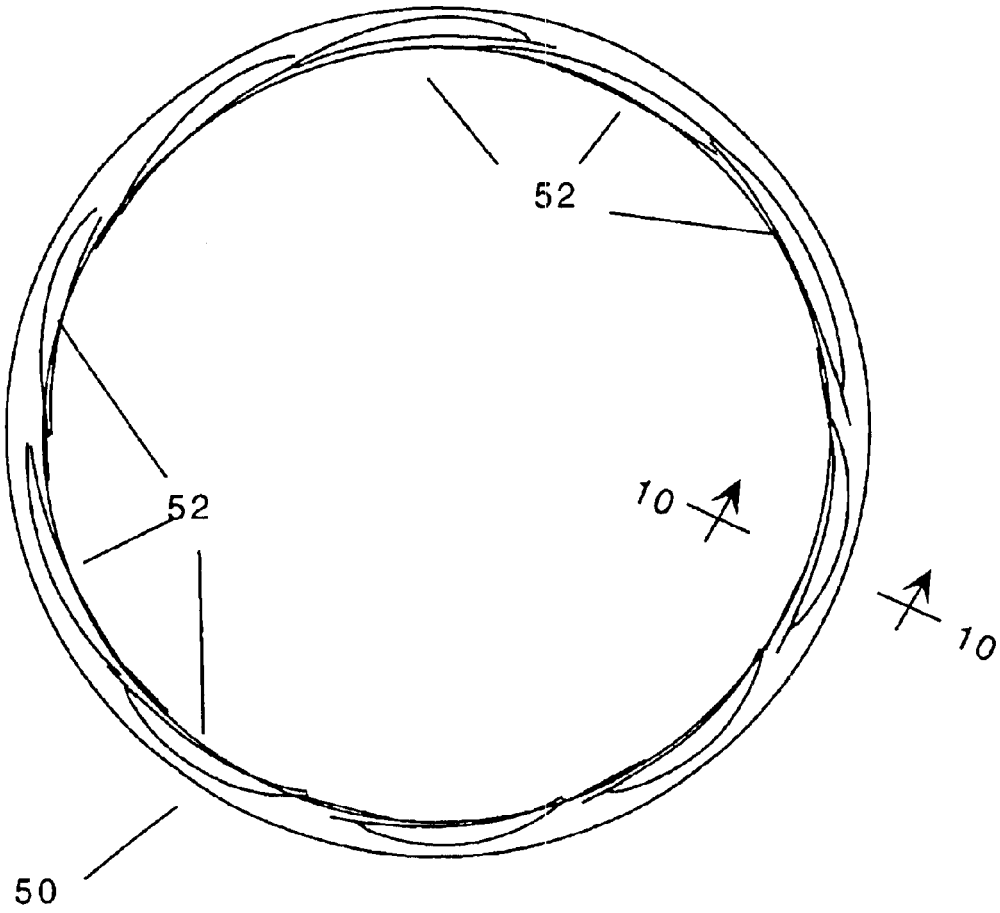
FIG. 8*b* is a front view of a tip ring having the third groove pattern with a second profile.
Figure 10:
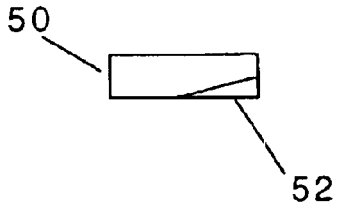
FIG. 10 is a cross-sectional view taken along the lines 10—10 of FIG. 8*b* of one of the grooves of FIG. 8*b* showing the pattern as being angled.

As shown in FIGS. 8*a*–10, the grooving pattern for both the disk injection seal and the eye ring seal also can be a spiral groove pattern. FIG. 8*a* shows a tip ring 50 with spiral grooves 51. FIG. 9 shows these grooves have a generally rectangular cross-section. FIG. 8*b* shows the tip ring 50 with radial tapered grooves 52. FIG. 10 shows these grooves 52 to be angled.

Referring now to FIG. 1, two seals are mounted at the eye of the impeller to prevent excessive gas flow into the suction of the impeller. The seals (also called eye rings) consist of a smooth ring 10 mounted on the impeller eye, and a mating ring 12 consisting of recessed pockets 13, is also to the case as shown in FIG. 1.

Figure 4:
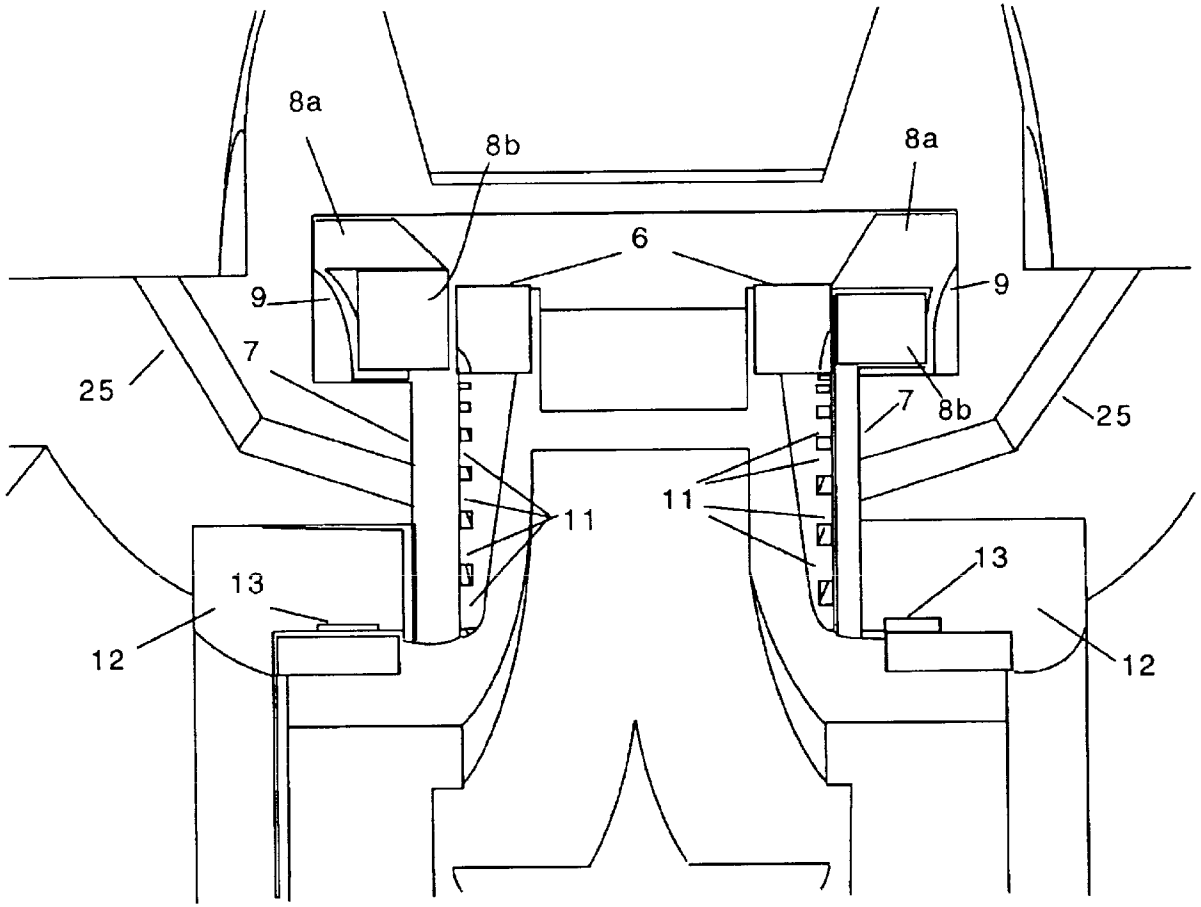
FIG. 4 is a detail cross-sectional view of the invention showing gas ports and the chambers formed by the seals.

The injected gas mentioned above has sufficient pressure to inject itself into the eye of the impeller, i.e.; its pressure is greater than the pump head developed by the pump. FIG. 4 shows the gas handling structure. As discussed above, the pockets (or grooves) in the tip rings are set to control the amount of gas injected. The chambers 7 formed by the eye ring seal and the tip injection seal are ported to an external source of pressurized fluid. The ports 25 carry the gas to the chambers 7 as shown in FIG. 4. In this way, the chamber pressure on the opposing sides of the impeller shrouds controls the impeller thrust.

Thus, by injecting a low viscosity fluid on the back side of the impeller and sealing the chamber at the eye side of the impeller, the efficiency of the pump can be increased by drastically reducing the disk friction and the normal fluid leakage loss that flows around the back side of the impeller and through the small gap at the impeller eye.

Note that the above design can work also with open-faced impellers with only one shroud. In this design only the impeller tip seal ring is used.

Note also that the seal rings described above can be used for abrasive service pumps to inject a clean fluid into the discharge stream reducing the amount of exposed surface to wear.

Finally, the seal rings can be utilized as a bearing system for the pump. The pressure produced by a radial or taper groove design is sufficient to support the rotor weight and seal the chamber. This allows for the elimination of external bearings.

Description of Operation

As discussed above, the disk injection ring 6 at the tip of the impeller has multiple grooves 11 with each groove throat open to the chamber 7 that has the pressurized gas. The motion of the injection ring as it rotates with the impeller imparts a centrifugal force to the gas and compresses it proportional to the head generation of the impeller. The gas pressure in the chamber is significant enough to allow the added head of the injection ring to inject a small quantity of gas into the discharge stream. The eye seal ring pockets are pressurized to allow for a controlled amount of gas to flow between the seal faces and be injected into the suction fluid.

The net result is that disk friction is significantly reduced, producing a more efficient centrifugal pump.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. In a centrifugal pump having a case, an impeller, and an impeller shroud, a disk fiction reducing system comprising:

a) at least one tip ring seal in fluid communication with said impeller; and b) a means for injecting a gas into said impeller through said tip ring seal, said means for injecting including a means for pressurizing said gas whereby said gas is at a pressure higher than a discharge pressure of the centrifugal pump;

c) wherein said at least one tip ring seal comprises a plurality of recessed pockets formed about said tip ring seal, and a port formed in each of said plurality of recessed pockets through which a low viscosity fluid may be directly injected.

2. The centrifugal pump according to claim 1 further comprising a mating seal having a compliant structure.

3. The centrifugal pump according to claim 2 wherein the compliant structure includes a spring.

4. The centrifugal pump according to claim 1 wherein the tip ring seal has a plurality of grooves formed thereon.

5. The centrifugal pump according to claim 4 wherein the plurality of grooves has a radial design.

6. The centrifugal pump according to claim 4 wherein the plurality of grooves has a tapered design.

7. The centrifugal pump according to claim 4 wherein the plurality of grooves has a recessed design.

8. The centrifugal pump according to claim 1, wherein the tip ring seal can be utilized as a bearing for the centrifugal pump.

9. A seal ring system for a centrifugal pump having an impeller having a first side and a second side, an impeller shroud and a housing, comprising:

a) a first eye seal sealably attached to the first side of said impeller;

b) a first tip ring, in operable contact with the first side of said impeller, wherein the first tip ring having a plurality of grooves formed therein;

c) a second eye seal sealably attached to the second side of said impeller;

d) a second tip ring, in operable contact with the second side of said impeller, wherein the second tip ring having a plurality of grooves formed therein;

e) a gas injection port, in communication with said plurality of grooves in said first tip ring; and f) a gas injection port, in communication with said plurality of grooves in said second tip ring.

10. The seal ring system for a centrifugal pump of claim 9 wherein the second eye seal further has plurality of grooves formed therein.

11. The centrifugal pump according to claim 9 wherein the plurality of grooves has a radial design.

12. The centrifugal pump according to claim 9 wherein the plurality of grooves has a tapered design.

13. The centrifugal pump according to claim 9 wherein the plurality of grooves has a recessed design.

14. A seal ring system for a centrifugal pump having an impeller having a first side and a second side, an impeller shroud and a housing, comprises:

a) a first eye seal sealably attached to the first side of said impeller;

b) a first tip ring, in operable contact with the first side of said impeller, said first tip ring having a plurality of grooves;

c) a second eye seal sealably attached to the second side of said impeller;

d) a second tip ring, in operable contact with the second side of said impeller, wherein the second tip ring having a plurality of grooves formed therein;

e) a first chamber formed in said housing and bounded by the first tip ring, the first eye seal, the impeller shroud and a wall of said housing;

f) a second chamber formed in said housing and bounded by the second tip ring, the second eye seal, the impeller shroud and a wall of said housing;

e) a first gas injection port, in communication with first chamber; and f) a second gas port in communication with said second chamber.

15. The centrifugal pump according to claim 14 wherein the plurality of grooves in said first and second tip rings have a radial design.

16. The centrifugal pump according to claim 14, wherein the plurality of grooves in said first and second tip rings have a tapered design.

17. The centrifugal pump according to claim 14 wherein the plurality of grooves in said first and second tip rings have a recessed design.

18. A method of reducing disk friction in a centrifugal pump having a housing, a first eye seal sealably attached to a first side of an impeller, a first tip ring, in operable contact with the first side of said impeller, said first tip ring having a plurality of grooves, a second eye seal sealably attached to a second side of said impeller, a second tip ring in operable contact with the second side of said impeller, wherein the second tip ring, having a plurality of grooves formed therein, a first chamber formed in said housing and bounded by the first tip ring, the first eye seal, the impeller shroud and a wall of said housing; a second chamber formed in said housing and bounded by the second tip ring, the second eye seal, the impeller shroud and a wall of said housing; a first gas injection port, in communication with said first chamber, and a second gas port in communication with said second chamber, comprising the steps of:

a) injecting a quantity of gas into said first and second gas injection ports;

b) moving said quantity of gas into said first and second chambers;

c) forcing said quantity of gas into the plurality of grooves on said first and second tip rings; and d) accelerating said quantity of gas, thereby pressurizing said quantity of gas to a pressure greater than a head pressure generated by said centrifugal pump.

* * * * *